US005515969A

United States Patent [19]

Schönenbach

[11] Patent Number: 5,515,969

[45] Date of Patent: May 14, 1996

[54] TOOL HOLDER WITH OPPOSING SURFACE ARRAYS OF BUNCHED BRISTLES

[75] Inventor: Heinz Schönenbach, Remscheid, Germany

[73] Assignee: Parat-Werk Schönenbach GmbH & Co. KG, Remscheid, Germany

[21] Appl. No.: 206,083

[22] Filed: Mar. 4, 1994

[30] Foreign Application Priority Data

Jun. 22, 1993 [DE] Germany ..... 43 20 592.5

[51] Int. Cl.[6] ..... B65D 85/28; B65D 73/00; A47F 7/00

[52] U.S. Cl. ..... 206/373; 211/70.6; 206/478

[58] Field of Search ..... 206/373, 372, 206/477, 478, 479, 495; 211/70.6

[56] References Cited

U.S. PATENT DOCUMENTS

| | | | |
|---|---|---|---|
| 2,995,256 | 8/1961 | Schoenfisch | 206/373 X |
| 4,189,048 | 2/1980 | Gaillard | 206/372 X |
| 4,439,884 | 4/1984 | Giorni | 211/70.6 X |
| 4,597,496 | 7/1986 | Kaplan | 211/70.6 |
| 4,682,691 | 7/1987 | Spiering | 206/373 |
| 5,005,710 | 4/1991 | Hofer | 206/373 X |
| 5,201,430 | 4/1993 | Artzer | 211/70.6 |

FOREIGN PATENT DOCUMENTS

| | | | |
|---|---|---|---|
| 0034266A1 | 8/1981 | European Pat. Off. . | |
| 2622827 | 5/1989 | France . | |
| 1578824 | 12/1970 | Germany . | |
| 3024414 | 1/1982 | Germany . | |
| 8219280.4 | 11/1982 | Germany . | |
| 3631690A1 | 3/1988 | Germany . | |
| 9000067.6 | 4/1990 | Germany . | |
| 9001360.3 | 5/1990 | Germany . | |
| 987641 | 3/1965 | United Kingdom . | |
| 2038613 | 7/1980 | United Kingdom . | |
| 2174366 | 11/1986 | United Kingdom | 206/373 |

*Primary Examiner*—Paul T. Sewell
*Assistant Examiner*—BethAnne C. Cicconi
*Attorney, Agent, or Firm*—Herbert Dubno

[57] ABSTRACT

A holder for tools, instruments and the like has a base surface juxtaposed with a countersurface, the base surface being provided with an array of elastically deformable bristles, e.g. on an artificial turf strip cemented to one of the surfaces, for engaging the objects inserted into the holder.

13 Claims, 5 Drawing Sheets

11
11a
12
12a
12b
12c
12d
13
14
15
15a
15b
16
17
18
10
C
W
S
P
IA
IB 10
11
11a
12
12a
12b
12e
13
14
15
16
18
IIA
IIB 10
11
11a
12
12a
12a'
12a''
12b
12e
13
14
15
16
IIIA
IIIB

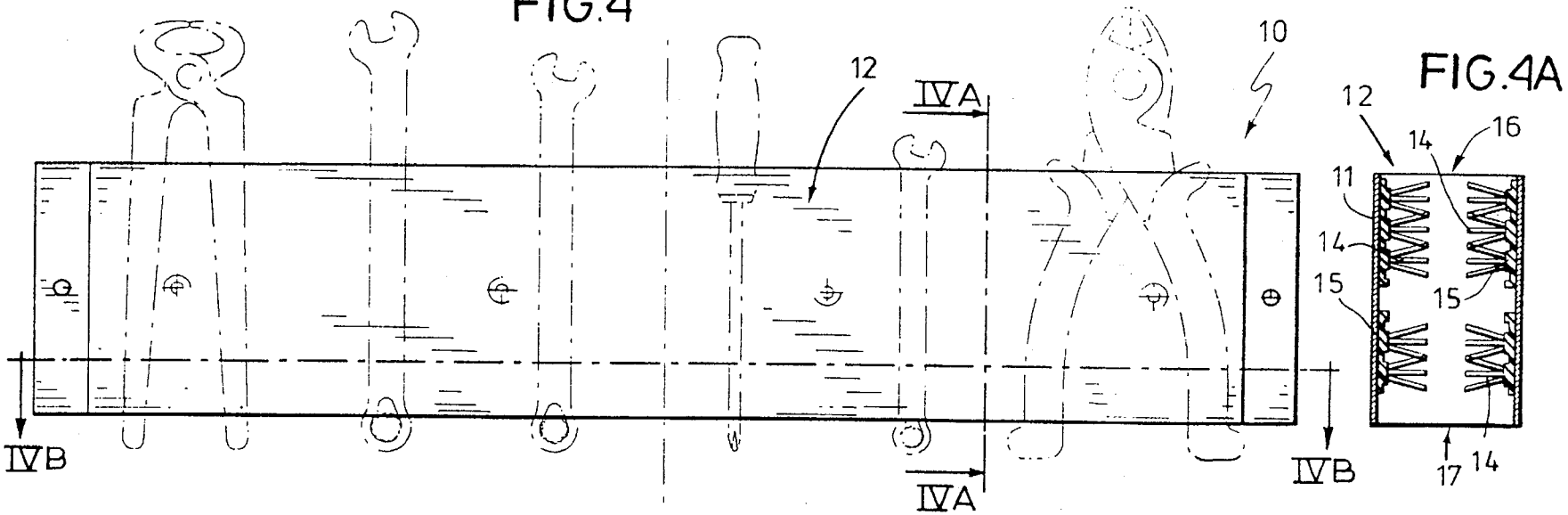
FIG.4
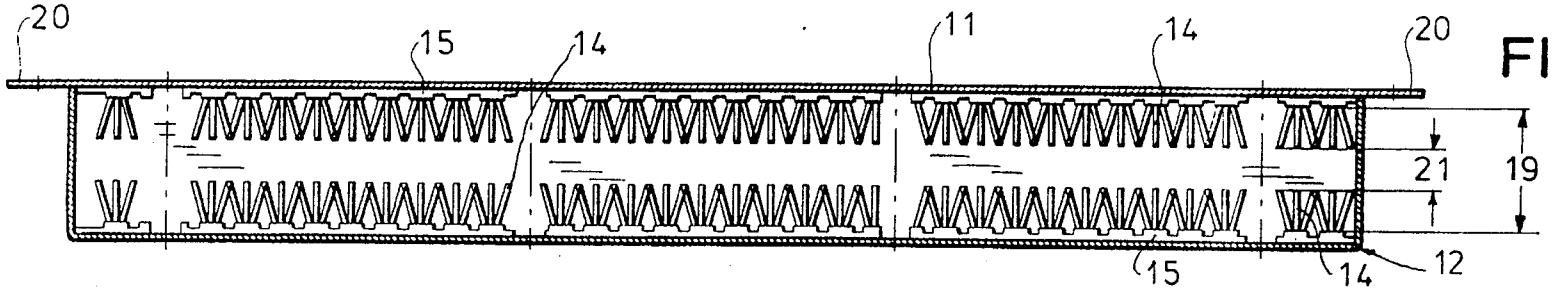

TOOL HOLDER WITH OPPOSING SURFACE ARRAYS OF BUNCHED BRISTLES

FIELD OF THE INVENTION

My present invention relates to a device for receiving and holding tools, instruments, writing implements or like objects by resiliently retaining same in a gap into which the object is inserted.

More particularly, the invention relates to a holder of the type in which a multiplicity of elastic members project from a base surface across a gap toward a countersurface and the objects are retained in the gap at least in part by resilient deformation of the projecting members.

BACKGROUND OF THE INVENTION

Devices for receiving and holding in readiness, tools, instruments, utensils, writing implements or the like have been provided heretofore in a wide variety of embodiments for mounting upon a wall, for insertion into an instrument cabinet or for mounting at other locations at which the availability of the objects retained is of advantage. Some of these devices make use of plate-like or bar-like units with loops or clamps provided thereon or therein and in which a tool or instrument or implement can be inserted with its grip, shaft, handle or other portion being engaged or locked by the clamp or in the loop.

These devices tend to be of a fixed configuration with respect to the types of objects which can be engaged and at least are not particularly variable or versatile as to the kind, number and size of the object to be retained. In German Utility Model DE 82 19 280 U, a device for holding implements in readiness is disclosed which can accommodate a plurality of hand tools, small instruments or like parts and which is constructed generally in accordance with closet or chest principles with a base body and a closure cover swingably mounted thereon.

Both on the base body and in the cover, foam material inlays are provided which have elastic projections from respective base surfaces in the form of foam pyramids. Upon closing the cover half, between the mutually juxtaposed foam inlays or between their pyramid-shaped projections, a gap is provided in which the objects can be clamped by elastic deformation of the projections. It is not possible with the clamping device effective, i.e. with the cover closed, to remove a tool from the holder or insert a tool into the holder. As a consequence, the aforedescribed device serves only to secure the objects during transport. The device cannot readily be provided as a wall-mounted unit without the danger that all of the objects will fall out whenever the cover is open.

OBJECTS OF THE INVENTION

It is, therefore, the principal object of the present invention to provide an improved device for holding tools, instruments, implements and other objects which avoids the drawbacks of earlier devices as described and which enables, in a simplified manner, insertion and removal of an object.

It is also an object of the invention to provide a wall-mountable holder for tools, instruments, implements which is highly versatile with respect to the number of types of objects which can be retained and which facilitates insertion and removal of the object.

Still another object of the invention is to provide an improved tool holder which is capable of holding objects of a wide variety of shapes and sizes.

A further object of my invention is to provide a device for holding tools and like objects in which a gap is provided to receive the objects and the objects are resiliently held in the gap in such manner that a large number of differently shaped objects can be retained and the device itself has a universal applicability, i.e. can be mounted on walls, can be mounted on or affixed to shelves, can be provided in pockets or cases and can be utilized in attache cases as writing implement holders or in tool boxes as tool holders, etc.

SUMMARY OF THE INVENTION

These objects and others which will become apparent hereinafter are attained, in accordance with my invention, in a device in which a gap is at least partly spanned by a multiplicity of bristles in which a gap is open at least along one side so that the object can be inserted to deflect the elastic bristles whose restoring forces press the bristles against an object to provide the clamping effectiveness. In this case, therefore, the elastic projections which extend across the gap from a base surface toward a countersurface are elastically deflectable bristle-like elements.

When the base surface from which the bristles project and the countersurface are juxtaposed with one another across a gap of fixed width, the base surface of the countersurface no longer needs to be relatively movable via flaps, covers or like swingable parts, but rather can be spatially fixed. This means that the gap is constant and that it is provided with at least one end region which forms an insertion opening. The objects can thus be inserted and removed through this opening. When both end regions are open, of course, the objects can be inserted through the gap so that they project from opposite sides thereof and thus can be inserted from one end or the other end and, conversely, can be removed through either end. The gap thus provides a throughgoing passage for the objects.

According to the invention, the elastic projections are constituted by brush-like elements, i.e. the bristles which can be bundled or grouped as in a brush. The bristles are elastically deformable independently and in the bundle-like groups and can be disposed in a rectangular array of columns and rows so that they are elastically deflected by objects inserted into the gap. The objects are retained by the elastic restoring force of the bristles and the friction with which the bristles engage the objects. The retaining forces can be substantial when a large number of bristles engage an object and it is, therefore, not necessary to utilize a foam with high compressibility which may make it difficult to insert the object into a gap between foam pyramids. Bristle-like clamping elements, moreover, are substantially more robust and hard wearing than foam cushions.

The clamping effect of the device of the invention is based upon the fact that upon insertion of an object into the gap in a direction transverse to the brush-like elements, the brush-like elements which extend transverse to the direction of insertion and the object surfaces are deflected to one side or another by the object against the resilient restoring force thereof so that the restoring forces of the bristles collectively applied to the object hold the latter in place. If a number of objects are provided close to one another in the device, these forces advantageously are superimposed or support one another.

The use of bristle-like elements to receive and hold utensils is, of course, generally known, for example as described in German Patent DE 36 31 690 A1, although these systems cannot be compared with the device of the invention. These earlier devices provide a container with a bottom, a peripherally-closed side wall and a receptacle opening, the container being filled with substantially mutually parallel bristles which are perpendicular to the bottom and are directed toward the container opening. The insertion of the objects is in the longitudinal direction of the bristles. By contrast, the tools inserted into the device of the present invention are inserted in a direction transverse to the orientation of the bristles, and, therefore, are retained by the bristles in a different manner.

A unit of the type described in DE 36 31 690 A1 cannot, therefore, be provided in a space-saving manner in a tool box or tool case, cannot be used in a comparatively small size for retention of a row of objects and cannot readily be mounted in a compact manner on a wall.

Indeed, with the earlier system the device can only be oriented so that it is vertical or slightly off vertical if the objects are not to fall out of the device.

Finally with respect to this earlier unit, it is noted that the basic principle of operation of this prior art device is that the bristles within the container are deformed generally in a funnel shape to produce the clamping force. Because of the way in which the restoring force is generated in this device, the clamping force applied to objects is low and basically the bristles can prevent the objects from moving around excessively in the receptacle but cannot retain them against significant forces tending to withdraw the articles from the container. In fact, in this earlier system the articles are retained primarily by their weight rather than by the clamping force of the bristles against the article so that as soon as the container is tilted sufficiently from the upright position so that the weight of the article acts to draw the article out of the container, the article tends to fall free.

According to a further feature of the invention, the gap is open along the longitudinal edge opposite the previously mentioned edge to enable the object to be held to extend through the gap from one of the longitudinal edges to the other. The bristles are preferably provided in spaced-apart bundles and another array of bristles, also in spaced-apart bundles, can be provided on the countersurface to extend toward the bristles of the base surface, whereby the object to be held is retained by bristles of both arrays.

The bristles can be anchored in and bonded to material forming the base surface, preferably a strip of synthetic resin material. The holder for the base surface can be juxtaposed with a wall forming the countersurface and the strip can be provided on this holder. Advantageously, the holder is a U-section stirrup-like member secured with an open side toward the wall. The gap can be closed in part by a bottom opposite the longitudinal edge and supporting the objects to be held.

Alternatively, the surfaces provided with the bristles or juxtaposed therewith are formed by opposite broad walls of rectangular cross section having a strip provided with bristles on at least one of the broad walls. The bristles can be provided upon at least two transversely spaced strips extending longitudinally on the base surface.

A spacing between the strips can vary from one end of the gap to an opposite end thereof to enable the holder to more readily retain objects of different lengths. This spacing can vary continuously. Advantageously, the bristles are bristles of a strip of commercial carpeting, namely, synthetic turf and most preferably the outdoor synthetic turf marketed as AstroTurf by the firm Monsanto.

More particularly, the bristles can be the bristles of synthetic carpeting of the type described in German Patent DE 15 78 824 and commercially marketed as AstroTurf by Monsanto, which carpeting is available in rolls of a width of 0.91 m and lengths of 16 or 17 m. The strips used for the purposes of the present invention can be cut from these webs and attached to the holder by any conventional adhesive.

For objects which are not very heavy and which do not require very high clamping forces, the AstroTurf DMS widely used as a dirt collector and outdoor terrace carpeting for normal use can be employed. For heavier objects, I prefer to use a carpeting with stiffer bristles of the type AstroTurf H-DMS which is utilized for dirt-collecting floor coverings which are intended to be subjected to greater usage.

It is, of course, especially advantageous that the invention can make use of a material of market availability in which the bristles are provided in bundles on the carpeting material with small gaps between the bundles so that deflection of the bristles is possible.

Additional product information with respect to such carpeting can be obtained from Monsanto (Germany) GmbH Immermannstr. 3400 Dusseldorf 1, Germany or the U.S. facilities of Monsanto.

More specifically, the device for holding tools, instruments, writing implements and other objects can comprise:

means for forming a substantially stiff elongated base surface;

means for forming a countersurface spacedly juxtaposed with the base surface to define an elongated gap between the surfaces open at least along one longitudinal edge of the gap;

means for securing the base surface in spatially fixed relationship with the countersurface to maintain a width of the gap; and a longitudinal array of elastically deflectable resilient bristles extending from one of the surfaces toward the other of the surfaces and deflectable by an object to be held inserted into the gap through the longitudinal edge of the gap to retain the object to be held by elastic force of deflected bristles against the object to be held.

BRIEF DESCRIPTION OF THE DRAWING

The above and other objects, features, and advantages will become more readily apparent from the following description, reference being made to the accompanying drawing in which:

FIG. 4 is an elevational view of a comparatively simple bar-shaped holder having two juxtaposed strips of bristles for holding especially bulky or heavy articles, in accordance with the present invention;

FIG. 4A is a cross sectional view taken along the line IVA—IVA of FIG. 4;

FIG. 4B is a cross sectional view taken along the line IVB—IVB of FIG. 4; and

SPECIFIC DESCRIPTION

Figures 1, 1A, 1B:
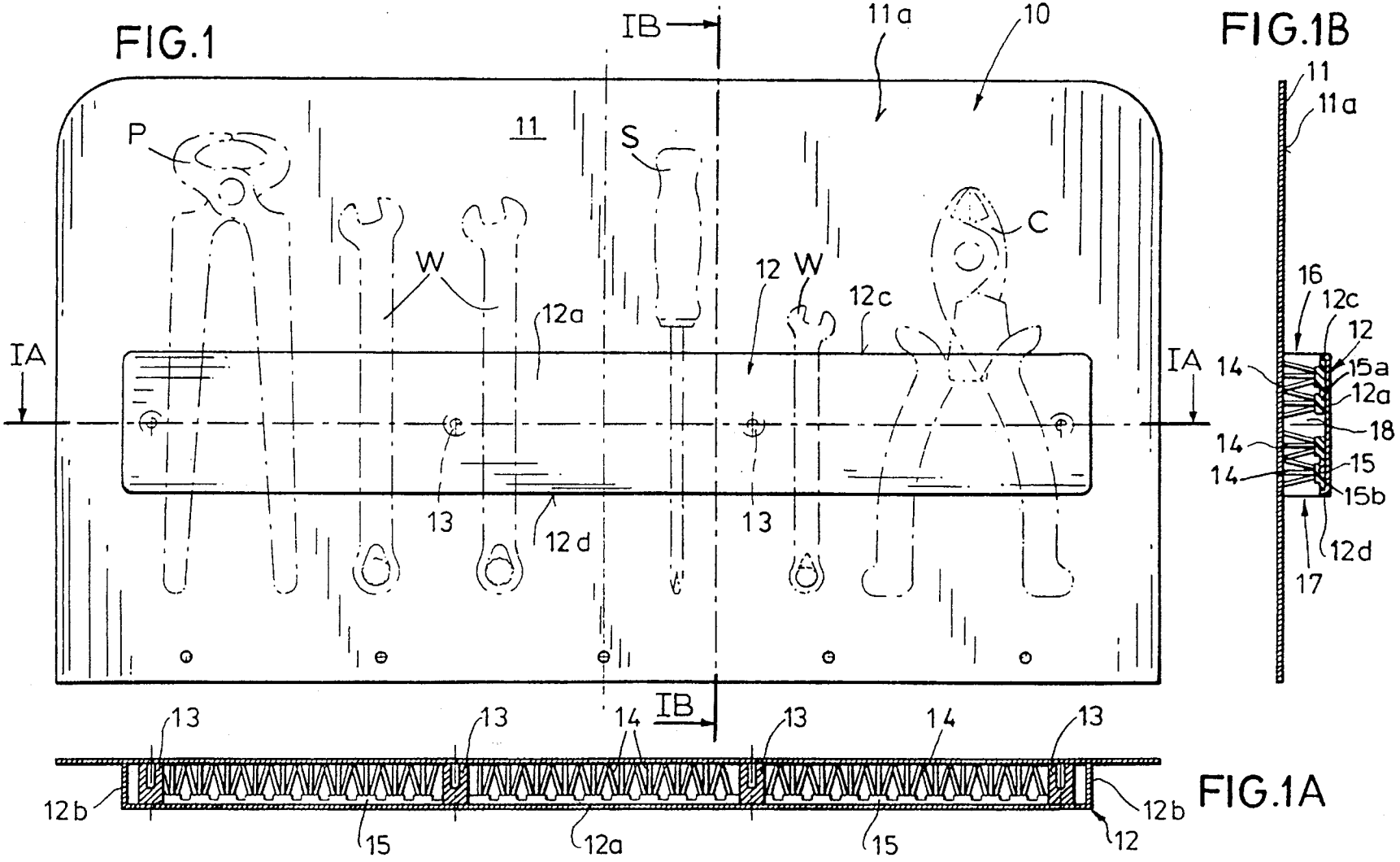
FIG. 1 is an elevational view of a holder in which the countersurface is a plate, for example for use in a tool box.
FIG. 1A is a cross sectional view taken along the line IA—IA of FIG. 1.
FIG 1B is a cross sectional view taken along the line IB of FIG. 1.

The holder represented at 10 in its entirety in FIGS. 1, 1A and 1B, comprises a plate 11 which forms at 11*a* the countersurface and to which is connected the bar 12 forming the base surface or main part of the clamping device. This main part 12 of the device 10 can be composed of a plastic (synthetic resin), sheet metal or other appropriate material and is in the form of a substantially U-shaped or stirrup-shaped body with a longitudinally-extending base segment 12*a* and two lateral shanks 12*b* bent at right angles to the segment 12*a*. The segment 12*a* can have several rivet or screw holes in spacers 13 through which, by screws or rivets, the main part 12 of the device 10 can be connected to the plate 11. The screws or rivets can be inserted from the back side of the plate 11. The spacers 13 provided with screw holes or rivet holes maintain a gap between the juxtaposed surfaces of the members 11 and 12.

Within the space enclosed by the main part 12, a multiplicity of elastic projections 14 project freely from the base segment 12*a* toward the wall 11. These projections 14 extend from a base surface 15 of the segment 12*a* parallel to and juxtaposed with the surface 11*a*.

The main part 12 thus forms a holder for the member applied to the base surface and from which the projections 14 extend. According to the invention, the projections 14 are bristles of a strip of carpet, especially an artificial turf-type carpet which is cemented or glued to the segment 12*a* of the holder. The carpet can be attached in other ways, e.g. by the screws or rivets which pass through the spacers 13 and can extend through holes in the artificial turf. The free ends of the bristle elements 14 can approach the surface 12*a* and can, if desired, contact it.

The holder as illustrated in FIGS. 1, 1A and 1B can have a horizontal edge 12*c* of the main member 12 which is spaced from the surface 11*a* to define an insertion opening 16 communicating with the upper edge or end of the gap. The slot-like lower opening 17 may also be provided so that, as shown in FIG. 1 in dot-dash lines, objects can extend from the bottom of the holder 12.

The objects can include tools like the pincer P, wrenches W, a screw driver S and a side cutter C, by was of example. The tools can be inserted from the top or the bottom in this embodiment and will be retained by deflection of the bristles 14 and by the restoring force with which these bristles bear upon the tools.

As can be seen from FIG. 1B, the bristles 14 may be carried on two strips 15*a* and 15*b* of carpeting cemented to the base surface 15. Between these strips a narrow gap 18 is provided which facilitates deflection of the bristles into the free space.

Of course a single strip of the carpeting can extend the full height of the device. The configuration described can vary depending upon the thickness, weight or shape of the object to be gripped.

From the drawing it should be apparent that there are practically no limitations as to where in the device any particular object may be inserted. The objects can be provided side by side without any problem although they can be relatively widely spaced as shown. Of course where the spacers 13 are provided no objects can be retained although a pliers or the like can have its handles or shanks straddling such spacers to the left and right thereof as may be desired.

It should be also apparent that the holder with the objects retained therein can be mounted anywhere such a holder is desired and in any orientation without the danger that the tools will slip out of the holder.

The device can be upright, recumbent or inclined and in particular can be employed as a partition in a tool box or mounted on such partition.

Figures 2, 2A, 2B:
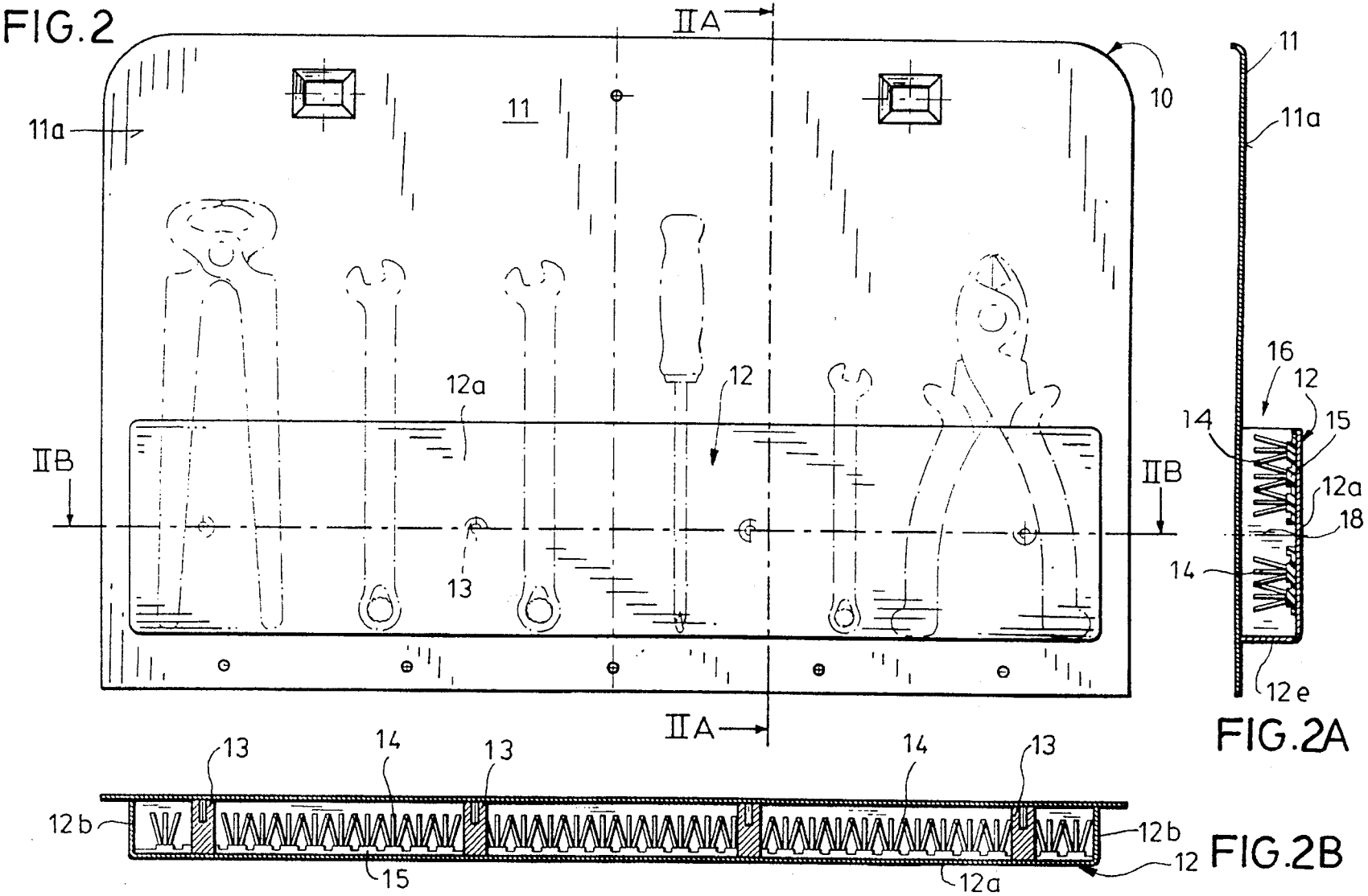
FIG. 2 is an elevational view similar to FIG. 1 but wherein the tool, implement, utensil or instrument holder is provided with a floor for supporting the objects received therein.
FIG. 2A is a cross sectional view taken along the line IIA—IIA of FIG. 2.
FIG. 2B is a cross sectional view taken along the line IIB—IIB of FIG. 2.

The device shown in FIGS. 2, 2A and 2B is generally similar to that of FIG. 1, FIG. 1A and FIG. 1B and hence corresponding reference numerals are used to designate corresponding parts and details as to what has been described need not be repeated. The main difference here is that the part 12, in addition to having the main segment 12*a* and the lateral flanges 12*b*, also has a bottom 12*e* which provides a bottom support for the lower ends of the objects retained in the device.

An arrangement of this type is especially advantageous when particularly heavy objects are to be retained and as to which there might be a fear that such objects can slide down from the device.

A bottom is also advantageous when all of the objects are to be held at the same level. Nevertheless, the holder does not require that particular objects be provided at particular locations and in particular positions. Once inserted into position, however, the tools are held in place by the bristles 14 which are deflected in the manner described. There is substantially no danger that the objects will tilt from one side to another or from the orientation upon insertion. In this case, the bristles need not support the objects against slipping downwardly through the device since that function is provided by the bottom 12*e*. The bristles do, however, limit lateral movement of the tools or other objects.

Figures 3, 3A, 3B:
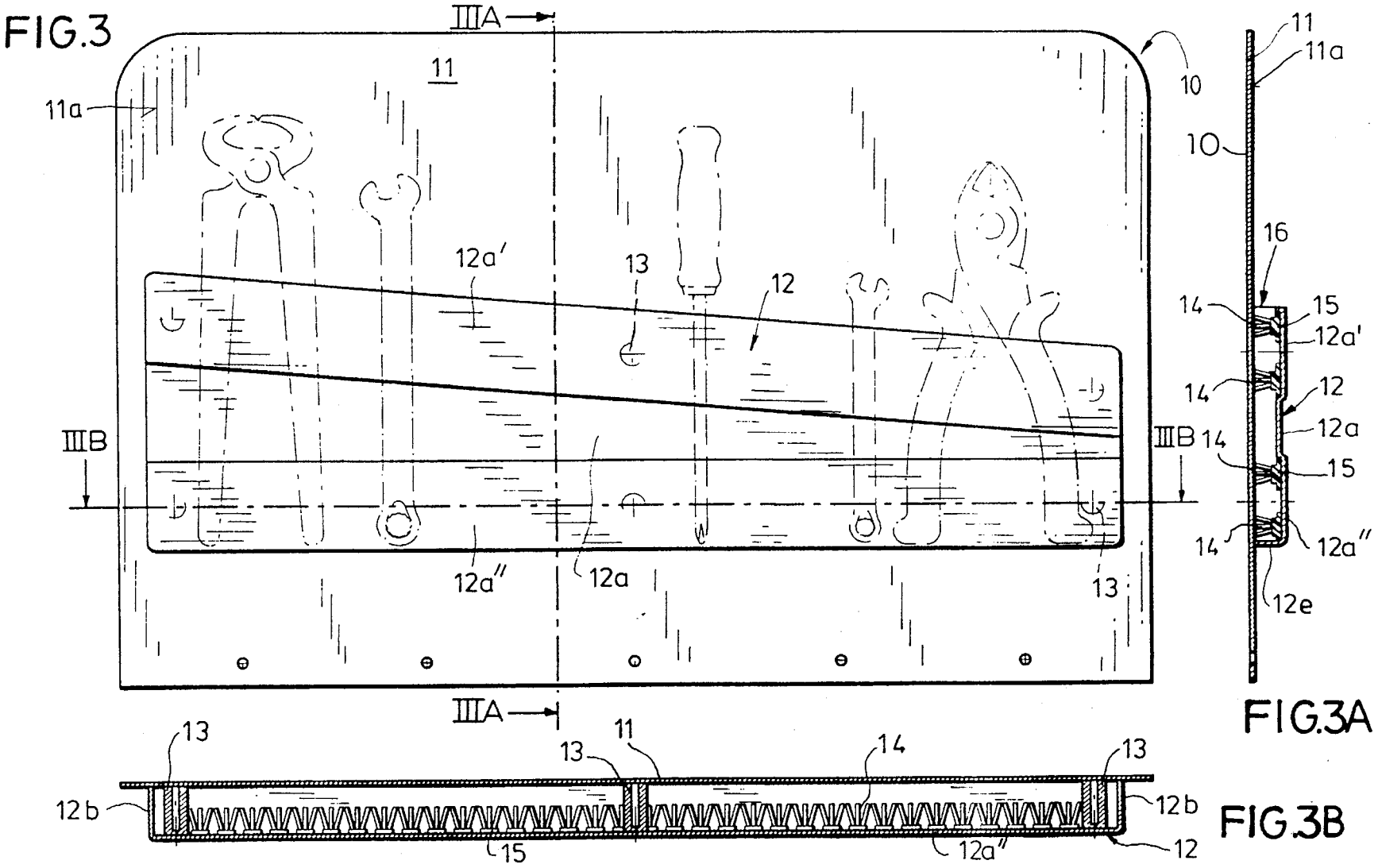
FIG. 3 is an elevational view of a holder for a set of wrenches or spanners of different lengths or other tools of varying length with two bristle strips including an angle with one another.
FIG. 3A is a cross sectional view taken along the line IIIA—IIIA of FIG. 3.
FIG. 3B is a cross sectional view taken along the line IIIB—IIIB of FIG. 3.

FIGS. 3, 3A and 3B illustrate an arrangement having an asymmetric main part 12*a* formed by two segments 12*a'* and 12*a"* including an angle between them, each of these segments being provided with a strip of the carpeting with respective bristle elements.

The wedge-shaped space 19 between these segments is free from these clamping elements. The important advantage of this arrangement is that an object to be inserted can be held at two spaced apart locations if the object is comparatively long and might otherwise project in greater part from the device. Furthermore, only two relatively narrow strips of the commercial artificial turf carpeting need be provided.

The apparatus of FIGS. 3, 3A and 3B has been found to be particularly advantageous for holding a set of open end wrenches or spanners, box wrenches or the like with greatly varying lengths and wrench sizes. In the system of FIG. 3 the smaller wrenches would be provided to the right and the longer wrenches to the left. The longer and heavier wrenches, of course, would be engaged by the spaced apart bristles.

Depending upon the type of object to be retained in the holder, it can be advantageous, as is apparent from FIG. 3A, to provide the free ends of the bristles 14 such that they contact the countersurface 11*a* or, as has been represented in FIG. 3B, that they are spaced somewhat therefrom.

FIG. 4 shows an arrangement of FIGS. 4, 4A, 4B which has been found to be particularly useful for holding relatively bulky or thick tools and which utilizes a double arrangement of bristle strips, i.e. bristle strips 15 extending both from the countersurface 11 and from the opposing member 12 toward one another.

The width 19 of the gap spanned by the bristles or within which the tools can be held is here clearly greater than the corresponding widths for the embodiments described earlier. Because of the fact that the bristles extend from opposite sides toward one another, it is possible to hold both larger objects as well as heavier and more bulky objects with a greater clamping force resulting from the restoring forces generated by the larger number of bristles which are deflected.

The main part 12 can be formed with lateral flanges 20 and can form a one-piece tubular structure with the counterwall 11.

Figure 5:
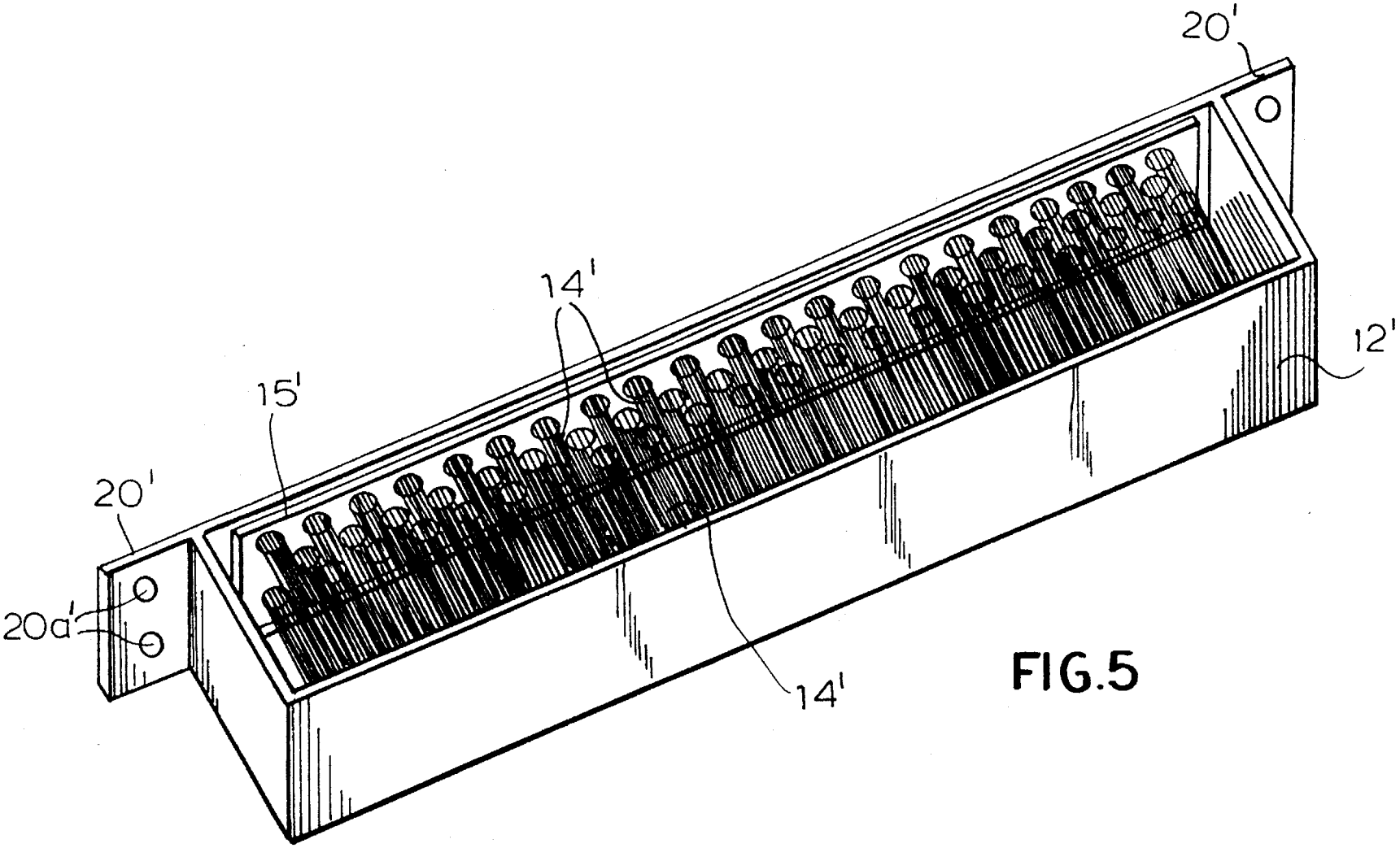
FIG. 5 is a perspective view of a holding device according to the invention fabricated from a tubular member.

A tubular structure of this type can be formed in one piece as shown in FIG. 5 with flanges 10'. In this case the strip-like body 12' can be cut from a continuous extruded tube of synthetic resin of which the carpeting strips of AstroTurf, e.g. as shown at 15', can be cemented to provide the oppositely directed bristles 14'.

The tubular unit, of course, can be affixed by holes 20*a'* formed in the flanges and screws through these holes to a wall, a partition of a tool chest, or the like.

In the embodiment of FIG. 4, 4A and 4B, it is clear that a gap 21 between the sets of bristles can be provided which can be larger or smaller depending upon the nature of the objects to be held.

It is important for all embodiments that the base surface 15 with bristle-like elements 14 be provided in which the base surface is as a rule a strip of a web material on which the elastically deflecting elements 14 can be mounted.

In all cases, moreover, a countersurface is provided against which the bristles may hold the objects. The countersurface is, in the embodiments of FIGS. 1–3B, the surface 11*a* of the plate 11, a wall or the like. In FIGS. 4, 4A, 4B and 5 the countersurface also has the bristle elements of a strip of the carpeting.

Because of the comparatively high clamping force generated by the bristle elements 14 upon the objects received in the holder, the holder 10, etc., can be provided in a practical orientation, so that, for example, both a vertical orientation or an inclined or even horizontal orientation can be provided. Furthermore, where no bottom is provided, the objects can be inserted from one or both sides or even from the bottom. The device can thus be provided below a cover member.

In particularly it can be used in instrument cases, tool boxes, tool pouches or the like or even as a separate holder which can be mounted wherever required, e.g. on a work bench or the like.

I claim:

1. A device for holding elongated objects, comprising:

means for forming a substantially stiff elongated base surface;

means for forming a countersurface spacedly juxtaposed with said base surface to define an elongated gap between said surfaces open at least along one longitudinal edge of the gap;

means for securing said base surface in spatially fixed relationship with said countersurface to maintain a width of said gap; and a surface array of bunches of elastically deflectable resilient bristles on said base surface, said bristles extending from said base surface toward the other of said surfaces and deflectable by an object to be held inserted into said gap through said longitudinal edge of the gap to retain said object to be held by elastic force of deflected bristles against said object to be held, said bunches of bristles being uniformly distributed over said base surface, said bristles being bristles of a strip of commercial carpeting.

2. The device defined in claim 1 wherein said gap is open along a longitudinal edge opposite said at least one longitudinal edge to enable said object to be held to extend through said gap from one of said longitudinal edges to the other of said longitudinal edges.

3. The device defined in claim 1, further comprising another surface array of bunches of bristles on said countersurface extending toward the bristles on said base surface, whereby said object to be held is retained by bristles of both said arrays.

4. The device defined in claim 1 wherein said bristles are anchored in and bonded to material forming said base surface.

5. The device defined in claim 4 wherein said bristles are formed on a strip of a synthetic resin material.

6. The device defined in claim 1, further comprising at least one holder for said base surface, said holder being juxtaposed with a wall forming said countersurface, said base surface being provided in the form of a strip carrying said bristles in said holder.

7. The device defined in claim 6 wherein said holder is a U-section stirrup-shaped member secured with an open side toward said wall.

8. The device defined in claim 7 wherein said gap is closed at least in part by a bottom opposite said longitudinal edge and supporting said object to be held.

9. The device defined in claim 1 wherein said surfaces are formed by opposite broad walls of a tube of rectangular cross section having a strip provided with said bristles on at least one of said broad walls.

10. The device defined in claim 1 wherein said bristles are provided upon at least two transversely spaced strips extending longitudinally on said base surface.

11. The device defined in claim 10 wherein a spacing between said strips varies from one end of said gap to an opposite end thereof.

12. The device defined in claim 11 wherein said spacing varies continuously from one end of the gap to the opposite end thereof.

13. The device defined in claim 1 wherein said carpeting is a synthetic turf.

* * * * *